US006409577B1

(12) United States Patent
Robinson

(10) Patent No.: US 6,409,577 B1
(45) **Date of Patent: *Jun. 25, 2002**

(54) METHOD FOR CONDITIONING A POLISHING PAD USED IN CHEMICAL-MECHANICAL PLANARIZATION OF SEMICONDUCTOR WAFERS

(75) Inventor: Karl M. Robinson, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/867,849

(22) Filed: May 29, 2001

Related U.S. Application Data

(63) Continuation of application No. 09/235,224, filed on Jan. 22, 1999, now Pat. No. 6,238,270, which is a continuation of application No. 08/651,109, filed on May 21, 1996, now Pat. No. 5,879,226.

(51) Int. Cl.[7] ..... B24B 1/00

(52) U.S. Cl. ..... 451/36; 216/89; 438/692; 451/41; 451/56

(58) Field of Search ..... 451/41, 54, 36, 451/56, 285, 60, 288, 59, 443, 444, 287; 438/692, 693, 694; 216/38, 88, 89

(56) References Cited

U.S. PATENT DOCUMENTS

| | | | | |
|---|---|---|---|---|
| 3,031,195 A | | 4/1962 | Lunsford | 274/9 |
| 5,081,051 A | | 1/1992 | Mattingly et al. | 437/10 |
| 5,154,021 A | | 10/1992 | Bombardier et al. | 51/262 A |
| 5,216,843 A | | 6/1993 | Breivogel et al. | 51/131.1 |
| 5,384,986 A | | 1/1995 | Hirose et al. | 451/444 |
| 5,522,965 A | | 6/1996 | Chisholm et al. | 156/636.1 |
| 5,536,202 A | | 7/1996 | Appel et al. | 451/285 |
| 5,628,862 A | | 5/1997 | Yu et al. | 156/345 |
| 5,645,682 A | | 7/1997 | Skrovan | 156/636.1 |
| 5,658,190 A | | 8/1997 | Wright et al. | 451/285 |
| 5,664,990 A | | 9/1997 | Adams et al. | 451/60 |
| 5,879,226 A | * | 3/1999 | Robinson | 451/287 |
| 5,913,715 A | | 6/1999 | Kirchner et al. | 451/56 |
| 6,155,902 A | | 12/2000 | Chen et al. | 451/56 |
| 6,238,270 B1 | * | 5/2001 | Robinson | 451/41 |

* cited by examiner

*Primary Examiner*—Timothy V. Eley
(74) *Attorney, Agent, or Firm*—Dorsey & Whitney LLP

(57) ABSTRACT

A method for conditioning a polishing pad used in chemical-mechanical planarization of semiconductor wafers. Waste matter on the polishing pad is dissolved with a conditioning solution selected to chemically dissolve the material of the waste matter. The conditioning solution preferably coats the areas on the wafer upon which the waste matter tends to accumulate during planarization. After a desired amount of waste matter is dissolved into the conditioning solution to bring the pad into a desired condition without mechanically abrading the waste matter from the pad, the conditioning solution containing the dissolved waste matter may be removed from the pad.

20 Claims, 8 Drawing Sheets

METHOD FOR CONDITIONING A POLISHING PAD USED IN CHEMICAL-MECHANICAL PLANARIZATION OF SEMICONDUCTOR WAFERS

CROSS-REFERENCE TO RELATED APPLICATIONS

This application is a continuation of U.S. patent application No. 09/235,224, filed Jan. 22, 1999, issued Jan. 22, 1999 as U.S. Pat. No. 6,238,270 which is a continuation of U.S. patent application No. 08/651,109, filed May 21, 1996, issued Mar. 9, 1999, as U.S. Pat. No. 5,879,226.

TECHNICAL FIELD

The present invention relates to a method for conditioning polishing pads used in chemical-mechanical planarization of semiconductor wafers.

BACKGROUND OF THE INVENTION

Chemical-mechanical polishing ("CMP") processes remove material from the surface of a wafer in the production of ultra-high density integrated circuits. In a typical CMP process, a wafer is exposed to an abrasive medium under controlled chemical pressure, velocity, and temperature conditions. Conventional abrasive mediums include slurry solutions and polishing pads. The slurry solutions generally contain small, abrasive particles that abrade the surface of the wafer, and chemicals that etch and/or oxidize the surface of the wafer. The polishing pads are generally planar pads made from a relatively porous material such as blown polyurethane, and the polishing pads may also contain abrasive particles to abrade the wafer. Thus, when the pad and/or the wafer moves with respect to the other, material is removed from the surface of the wafer mechanically by the abrasive particles in the pad and/or slurry, and chemically by the chemicals in the slurry.

FIG. 1 schematically illustrates a conventional CMP machine 10 with a platen 20, a wafer carrier 30, a polishing pad 40, and a slurry 44 on the polishing pad. An under-pad 25 is typically attached to an upper surface 22 of the platen 20, and the polishing pad 40 is positioned on the under-pad 25. In most conventional CMP machines, a drive assembly 26 rotates the platen 20 as indicated by arrow A. In another existing CMP machine, the drive assembly 26 reciprocates the platen back and forth as indicated by arrow B. The motion of the platen 20 is imparted to the pad 40 through the under-pad 25 because the polishing pad 40 frictionally engages the under-pad 25.

The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier, or an actuator assembly 36 may be attached to the wafer carrier 30 to impart axial and rotational motion, as indicated by arrows C and D, respectively.

In the operation of the CMP machine 10, the wafer 12 is positioned face-downward against the polishing pad 40 and at least one of the platen 20 or the wafer carrier 30 is moved relative to the other. As the face of the wafer 12 moves across the planarizing surface 42, the polishing pad 40 and the slurry 44 remove material from the wafer 12.

In the competitive semiconductor industry, it is desirable to maximize the throughput of the finished wafers and to minimize the number of defective or impaired devices on each wafer. The throughput of CMP processes is a function of several factors, one of which is the rate at which the thickness of the wafer decreases as it is being planarized (the "polishing rate"). Because the polishing period per wafer decreases with increasing polishing rates, it is desirable to maximize the polishing rate within controlled limits to increase the number of finished wafers that are produced in a given period of time.

CMP processes must also consistently and accurately produce a uniform, planar surface on the wafer because it is important to accurately focus the image of circuit patterns on the surface of the wafer. As the density of integrated circuits increases, it is often necessary to accurately focus the critical dimensions of the circuit pattern to better than a tolerance of approximately 0.1 $\mu$m. Focusing the circuit patterns to such small tolerances, however, is very difficult when the distance between the lithography equipment and the surface of the wafer varies because the surface of the wafer is not uniformly planar. In fact, several devices may be defective on a wafer with a non-uniformly planar surface. Thus, CMP processes must create a highly uniform, planar surface.

One problem with CMP processing is that the throughput may drop, and the uniformity of the polished surface may be inadequate, because the condition of the polishing surface on the pad deteriorates while polishing a wafer. The deterioration of the polishing pad surface is caused by waste particles from the wafer pad, and slurry that accumulate on the polishing pad. The accumulations of waste particles effectively alter the condition of the polishing surface on the polishing pad causing the polishing rate to drift over time. The problem is particularly acute when planarizing doped silicon oxide layers because doping softens silicon oxide making it slightly viscous as it is planarized. As a result, accumulations of doped silicon oxide glaze the surface of the polishing pad with a glass-like material that substantially reduces the polishing rate over the glazed regions. Thus, it is often necessary to condition the pad by removing the waste accumulations from its polishing surface.

Polishing pads are typically conditioned with an abrasive disk that moves across the polishing pad and abrades the waste accumulations from the surface of the pad. One type of abrasive disk is a diamond-embedded plate mounted on a separate actuator that sweeps the plate across the pad. Some pad conditioners remove a portion of the upper layer of the deteriorated polishing surface in addition to the accumulations of waste matter to form a new, clean polishing surface. Other pad conditioners may use a liquid solution in addition to the abrasive disks to dissolve some of the waste matter as the abrasive disks abrade the polishing pad.

A more specific problem related to conditioning polishing pads is that conventional pad conditioning devices and processes significantly reduce the throughput of CMP processing. During conventional conditioning processes with abrasive disks, abrasive particles often detach from the abrasive disks and particles of pad material often detach from the pad. The detached abrasive particles or pad material may scratch the wafer if the wafer is not removed from the pad as it rotates during conditioning, or if the pad is not cleaned after it has been conditioned. More specifically, therefore, conventional conditioning processes with abrasive disks reduce the throughput of CMP processing because removing the wafer from the pad and cleaning the pad after conditioning requires down-time during which a wafer cannot be planarized.

In light of the problems associated with conventional polishing pad conditioning processes, it would be desirable to develop a process for conditioning polishing pads in which the wafer is not removed from the pad and the pad does not need to be cleaned after conditioning.

SUMMARY OF THE INVENTION

The inventive method conditions a polishing pad used in chemical-mechanical planarization of semiconductor wafers while the semiconductor wafer remains in situ on the polishing pad, and without necessitating cleaning after the pad is conditioned. In accordance with the method of the invention, waste matter on the polishing pad is dissolved with a conditioning solution selected to chemically dissolve the waste matter. The conditioning solution preferably coats the areas on the polishing pad upon which the waste matter tends to accumulate during planarization. After a desired amount of waste matter is dissolved into the conditioning solution to bring the pad into a desired condition without mechanically abrading the waste matter from the pad, the conditioning solution containing the dissolved waste matter is preferably removed from the pad.

DETAILED DESCRIPTION OF THE INVENTION

The present invention is a method for quickly conditioning a pad in which the water does not need to be removed from the pad during the conditioning cycle, and the pad does not need to be cleaned after the conditioning cycle. An important aspect of the invention is that accumulations of waste matter on the pad are dissolved solely with a liquid conditioning solution, and then the conditioning solution containing the dissolved waste matter is removed from the pad. The present invention accordingly conditions the pad without mechanically abrading the pad. Unlike conventional conditioning methods using an abrasive disk, therefore, the method of the present invention does not produce potentially damaging particles that must be removed from the pad before the wafer can be planarized. Thus, a wafer can remain positioned against the polishing pad while the pad is conditioned, and the pad does not need to be cleaned after it is conditioned.

Figure 2A:
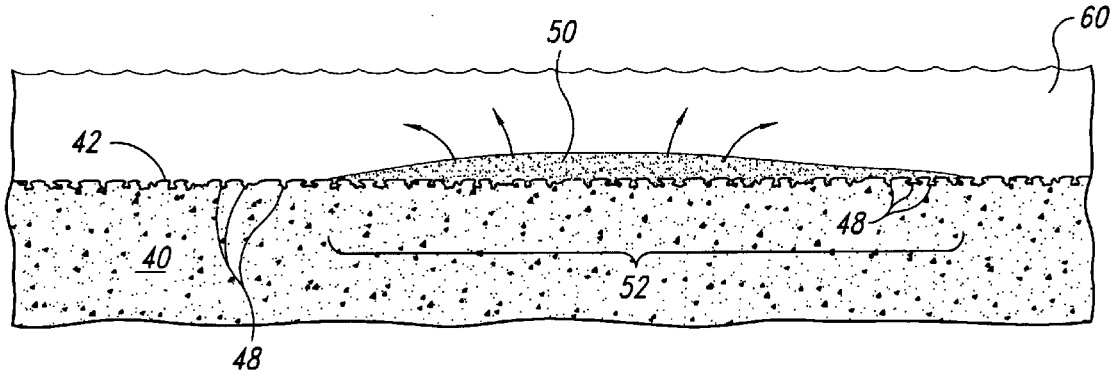
FIG. 2A is a partial schematic cross-sectional view of the polishing pad being conditioned at one point in a method of the invention.

FIGS. 2A illustrates a small portion of a polishing pad 40 being conditioned at an initial stage of a method of the invention. The polishing pad 40 typically has a number of pores 48 across the planarizing surface 42 of the polishing pad 40. It will be appreciated that the pores 48 illustrated in FIG. 2A are exaggerated for purposes of illustration. During the planarization of the wafer (not shown), a glazed region 52 of waste matter 50 covers a portion of the planarizing surface 42 and fills the pores 48. In accordance with the method of the invention, the waste matter 50 is dissolved in a conditioning solution 60 coating the surface of the polishing pad 40. The conditioning solution 60 removes the waste matter 50 until enough of the planarizing surface 42 is free of waste matter to bring the pad into a desired polishing condition.

Figure 2B:
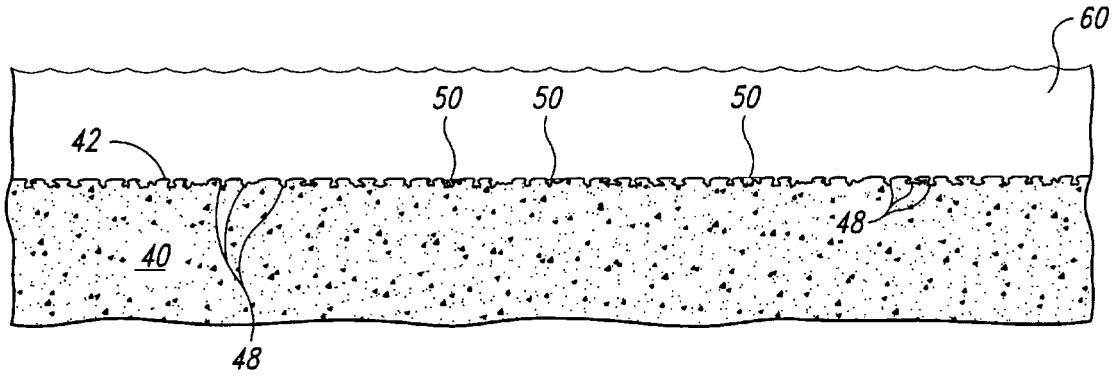
FIG. 2B is a partial schematic cross-sectional view of the polishing pad of FIG. 2A at another point in the method of the invention.

FIG. 2B illustrates the small portion of the polishing pad 40 of FIG. 2A being conditioned at another stage of the method of the invention. The conditioning solution 60 is left on the polishing surface 42 of the pad 40 for an adequate period of time to dissolve a desired portion of the waste matter 50. The dissolved waste matter 50 remains suspended in the conditioning solution 60 so that most of the polishing surface 42 and the pores 48 are substantially free of waste matter 50 at the end of the conditioning period. Thus, once a desired amount of waste matter 50 is dissolved in the conditioning solution 60, the conditioning solution containing the dissolved waste matter preferably is removed from the polishing pad 40.

The conditioning solution is selected to readily dissolve the particular type of waste matter 50 accumulated on the pad 40. Also, the conditioning solution 60 is preferably selected to dissolve the waste matter 50 without dissolving the polishing pad 40 itself or adversely affecting the CMP slurry or the wafer. The conditioning solution 60 is thus preferably selected to mix with the CMP slurry and to safely contact the wafer. In the specific case in which the waste matter 50 consists of primarily doped or undoped silicon oxide, the conditioning solution 60 is preferably made from a liquid having a pH of at least 10.5, and more preferably of at least 11.5. More particularly, the conditioning solution 60 is preferably made from ammonium hydroxide of an organically substituted ammonium hydroxide. Tetramethyl ammonium hydroxide is one suitable organically substituted ammonium hydroxide. Ammonium hydroxide is particularly useful because it is the primary chemical agent in many CMP slurries, and thus it mixes well with most CMP slurries and does not damage the wafer. As a result, the wafer may be left on the pad during conditioning with ammonium hydroxide. In another embodiment, the conditioning solution 60 may be made from an alkali hydroxide, such as potassium hydroxide. It will be appreciated, however, that the present invention is not limited to these conditioning solutions, as other compounds that dissolve the specific type of waste matter are also within the scope of the invention. Moreover, it will be appreciated that the present invention is not limited to solely to planarization processes that use a slurry that abrasively interacts with the wafer while chemically reacting with the materials that comprise the wafer. For example, the slurry may be comprised of abrasive particles to mechanically abrade the wafer, which are suspended in a chemically non-reactive suspension medium, such as water.

Figure 3A:
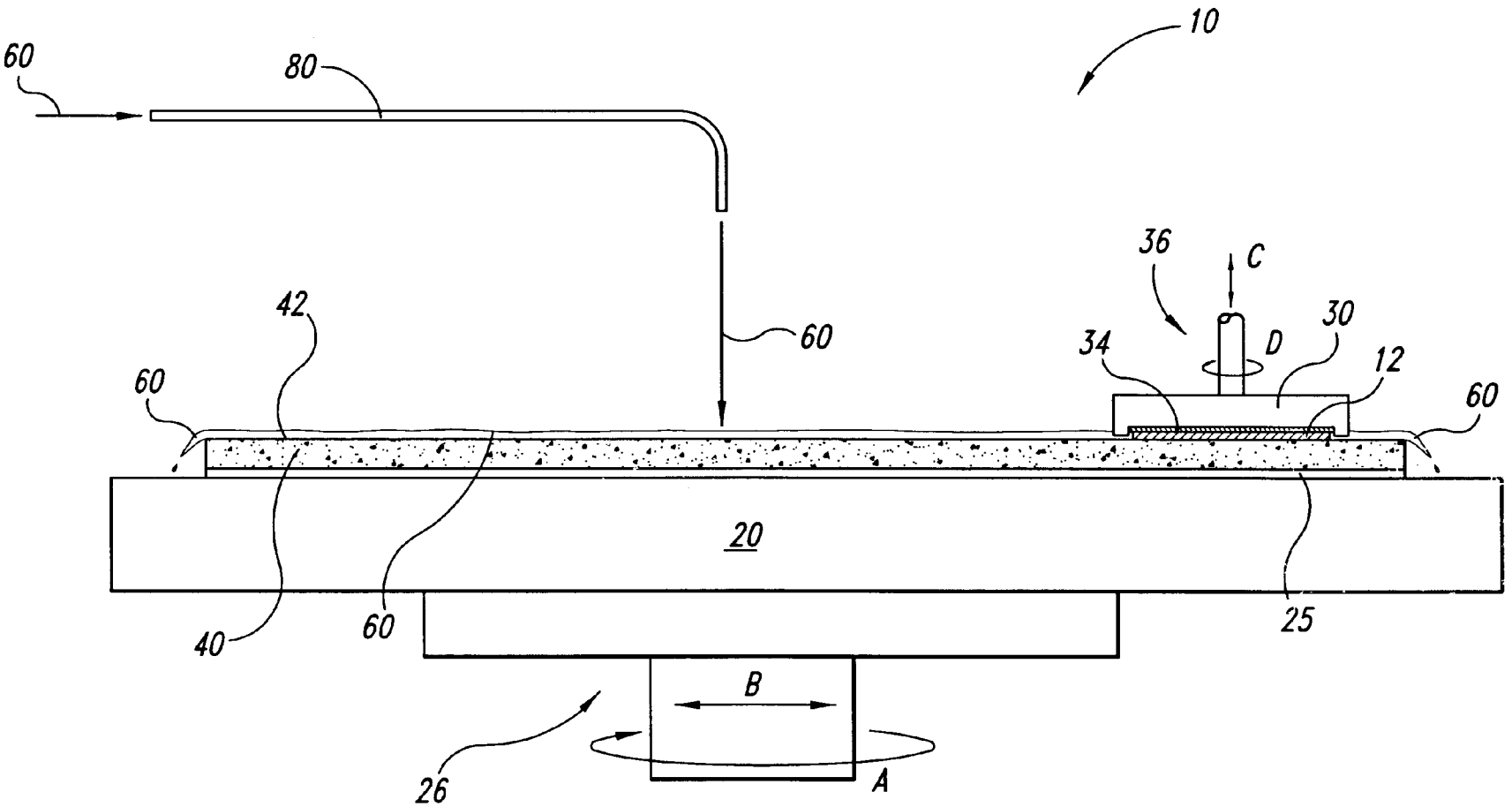
FIG. 3A is a schematic cross-sectional view of a polishing pad being conditioned in accordance with a method of the invention.
Figure 3B:
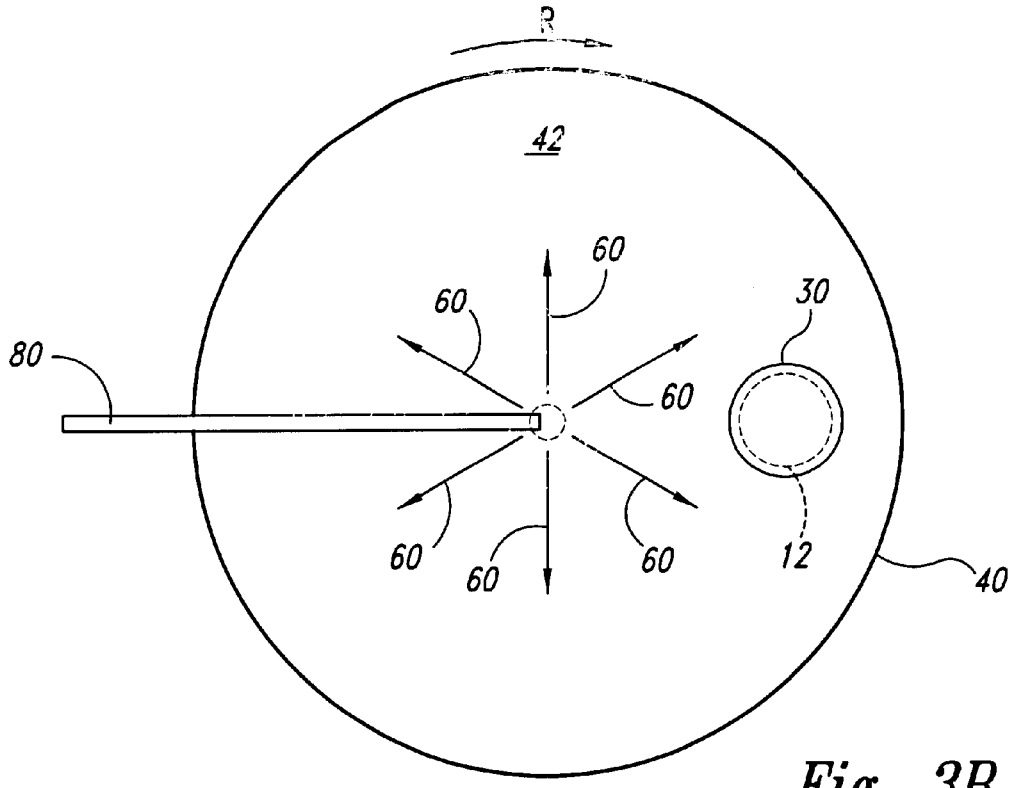
FIG. 3B is a top plan view of the polishing pad of FIG. 3A being conditioned in accordance with the method of the invention.

FIGS. 3A and 3B illustrate the embodiment of the method shown in FIGS. 2A and 2B at a macro level. The conditioning solution 60 preferably coats a desired portion of the planarizing surface 42 of the pad 40 with an adequate volume of the conditioning solution 60. To coat the pad with the conditioning solution 60, the pad is moved as the conditioning solution 60 is deposited onto the pad. For example, to coat substantially the whole surface of the rotating polishing pad 40, the conditioning solution 60 is deposited onto the center of the pad 40 through a pipe 80 as the polishing pad 40 rotates in a direction indicated by arrow R. The centrifugal force generated by the rotation of the polishing pad 40 drives the conditioning solution 60 radially outwardly towards the perimeter of the pad. The flow rate and viscosity of the conditioning solution 60, and the angular velocity of the polishing pad, are preferably adjusted to provide the desired volume of conditioning solution 60 across the surface of the polishing pad. The flow rate of conditioning solution may be between 10–1000 ml per minute, and is preferably between 200–500 ml per minute. The angular velocity of the polishing pad 40 may be between 0–100 rpm, and is preferably between 15–35 rpm.

Similarly, to coat a linear translating pad (not shown), the slurry is deposited across the width of the pad as the pad moves under the slurry dispenser. Linear translating pads are similar to belt-sanders in that the pad travels in a continuous loop around rollers. The slurry pipe accordingly extends over the width of the pad, and a series of holes run along the bottom of the pipe to deposit an even amount of slurry across the pad.

Figure 4:
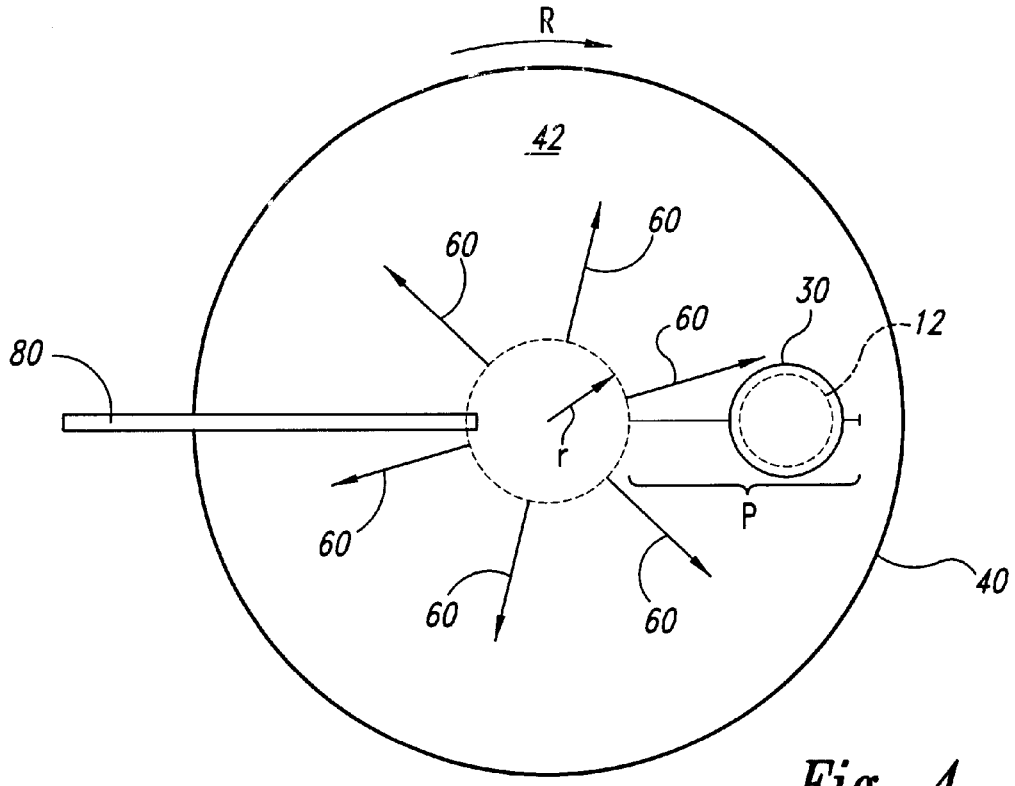
FIG. 4 is a top plan view of the polishing pad of FIG. 3A being conditioned in accordance with another embodiment of the method of the invention.

FIG. 4 illustrates another embodiment of the invention in which the pad is conditioned primarily in the region where glazing occurs. The wafer carrier 30 translates the wafer 12 along a path P that begins at a distance r from the center of the wafer and extends to a point near the perimeter of the pad 40. Glazing, therefore, does not occur in the area within the radius r because the wafer does not contact the planarizing surface 42 within this portion of the pad 40. The open end of the pipe 80 is thus spaced radially away from the center of the polishing pad 40 by a distance r so that the conditioning solution 60 drops onto the pad at the innermost point of the path P and flows radially outwardly under the centrifugal force of the pad 40. Thus, by spacing the dispensing end of the pipe 80 at the innermost radial point of the path along which the wafer 12 is translated, the conditioning solution 60 only conditions those portions of the pad subject to glazing. The primary advantages of conditioning only the outer portion of the pad are that less conditioning solution and time are required to condition the pad.

The conditioning solution 60 must also coat the planarizing surface 42 of the polishing pad for an adequate period of time to dissolve an adequate amount of waste matter and bring the pad into a desired condition. When the waste matter 50 consists of doped silicon oxide and the conditioning solution 60 is ammonium hydroxide, the conditioning solution 60 preferably coats the desired areas on the pad 40 for a period from 5–60 seconds. The actual conditioning period may vary depending upon the extent of glazing, and for other types of waste mater 50 and conditioning solutions 60. The invention, therefore, is not limited to a conditioning period of 5–60 seconds.

The conditioning period during which the conditioning solution 60 remains on the pad 40 is preferably controlled by the period of time during which the conditioning solution 60 is deposited onto the pad 40. In the case of coating the pad 40 by depositing the conditioning solution onto the pad 40 as it rotates, the conditioning period is substantially the same as the time during which the conditioning solution 60 is deposited onto the pad 40. Therefore, the conditioning period is preferably controlled by simply controlling the flow of the conditioning solution 60 through the pipe 80.

After the conditioning solution 60 coats the pad for a desired period of time to dissolve the desired amount of waste matter, the conditioning solution 60 containing the dissolved waste matter is removed from the planarizing surface 42 of the pad 40. In one embodiment, the conditioning solution 60 is removed from the pad by substituting the flow of conditioning solution 60 in the pipe 80 with a flow of CMP slurry. The CMP slurry deposited onto the pad 40 flows radially outwardly towards the perimeter of the polishing pad 40 in the same manner as the conditioning solution 60. As a result, the slurry solution occupies the space vacated by the conditioning solution 60 and sweeps any residual conditioning solution 60 radially outwardly off of the perimeter of the pad. In another embodiment, the conditioning solution 60 is removed from the pad by simply stopping the flow of condition solution 60 through the pipe 80 while continuing to rotate the polishing pad 40.

Figure 5:
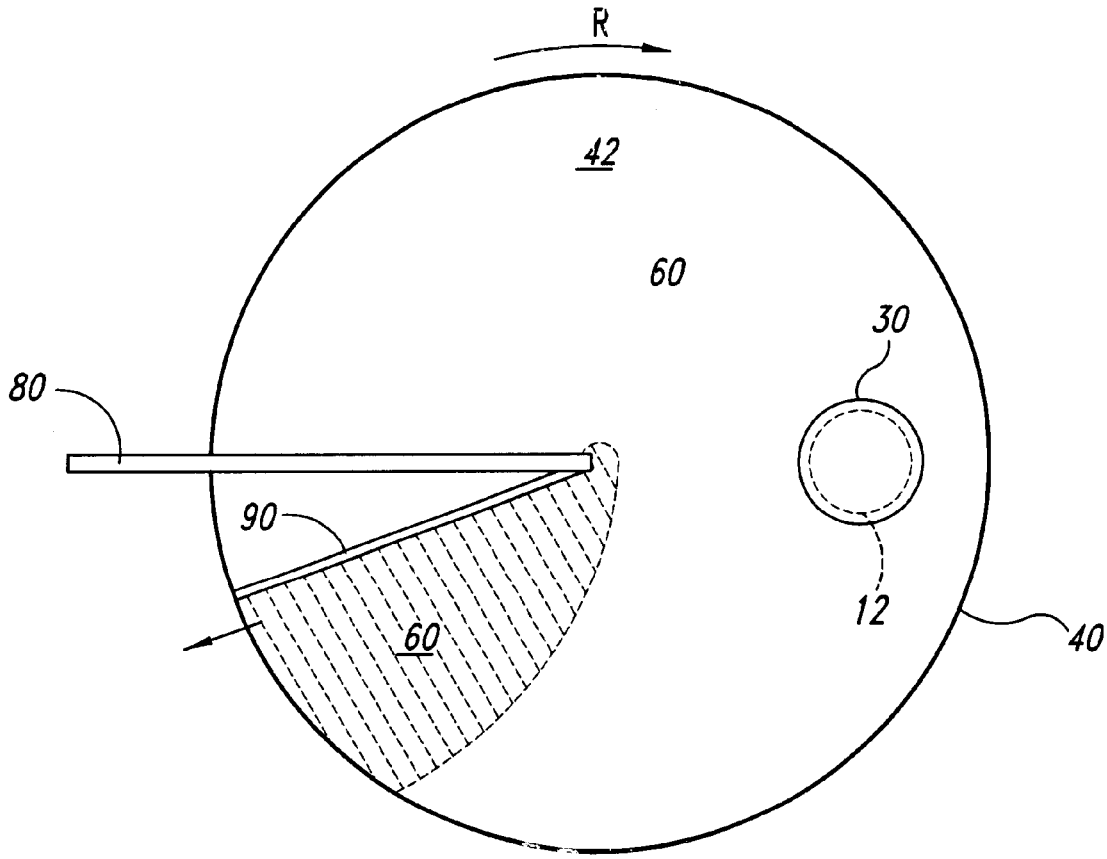
FIG. 5 is a top plan view of a polishing pad being conditioned in accordance with a method of the invention.

FIG. 5 illustrates another embodiment in which the conditioning solution 60 is removed from the planarizing surface 42 of the polishing pad 40 by a wiper 90. The wiper 90 preferably abuts the planarizing surface 42 of the pad 40, and it preferably extends along a radius of the pad 40. The conditioning solution 60 covers a portion of the planarizing surface 42 of the polishing pad 40 until it contacts the wiper 90, at which point the wiper 90 guides most of the conditioning solution 60 radially outwardly off of the perimeter of the polishing pad 40.

Figure 1:
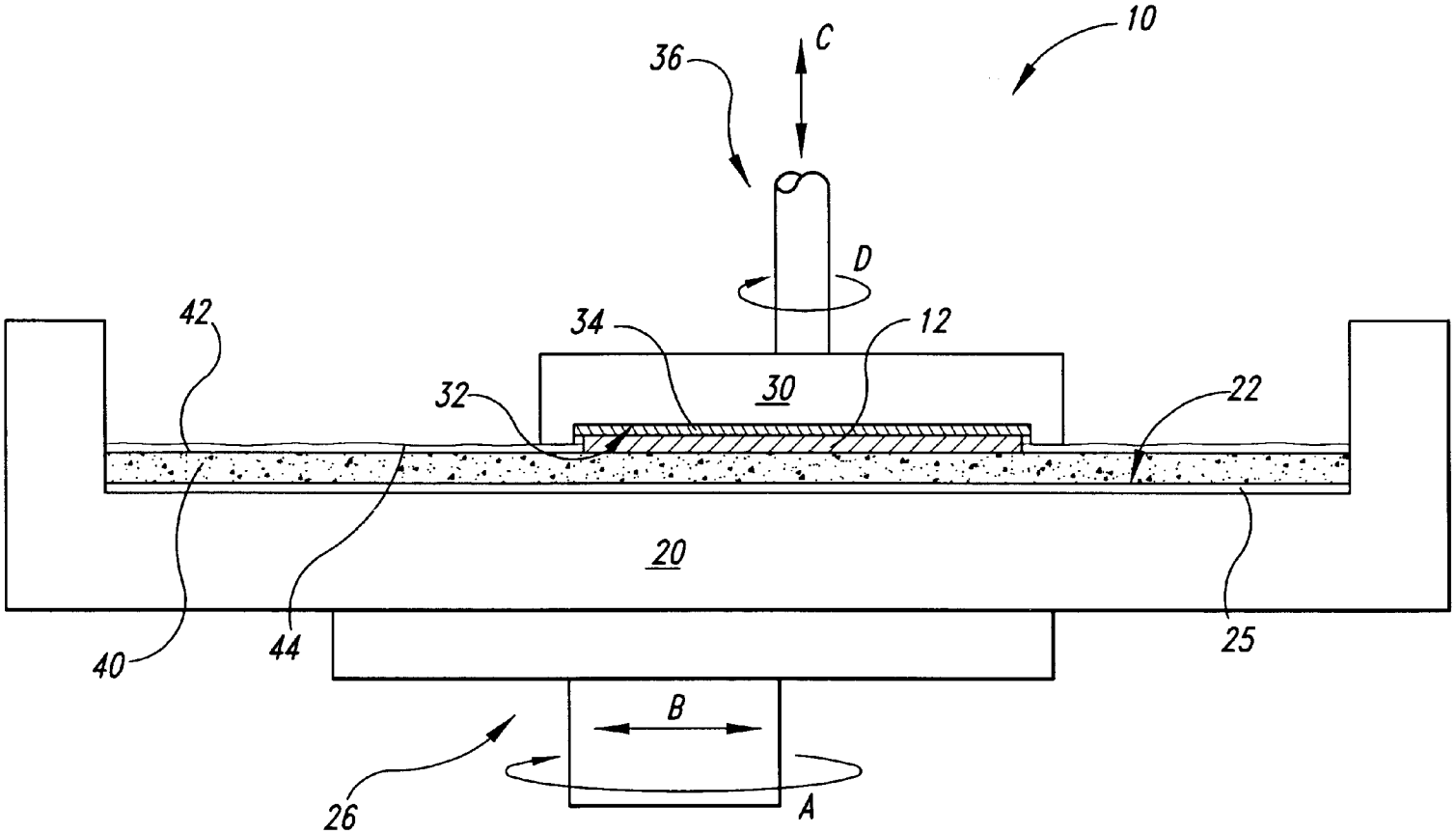
Fig. 1 (Prior Art)
FIG. 1 is a schematic cross-sectional view of a planarizing machine in accordance with the prior art.
Figure 6:
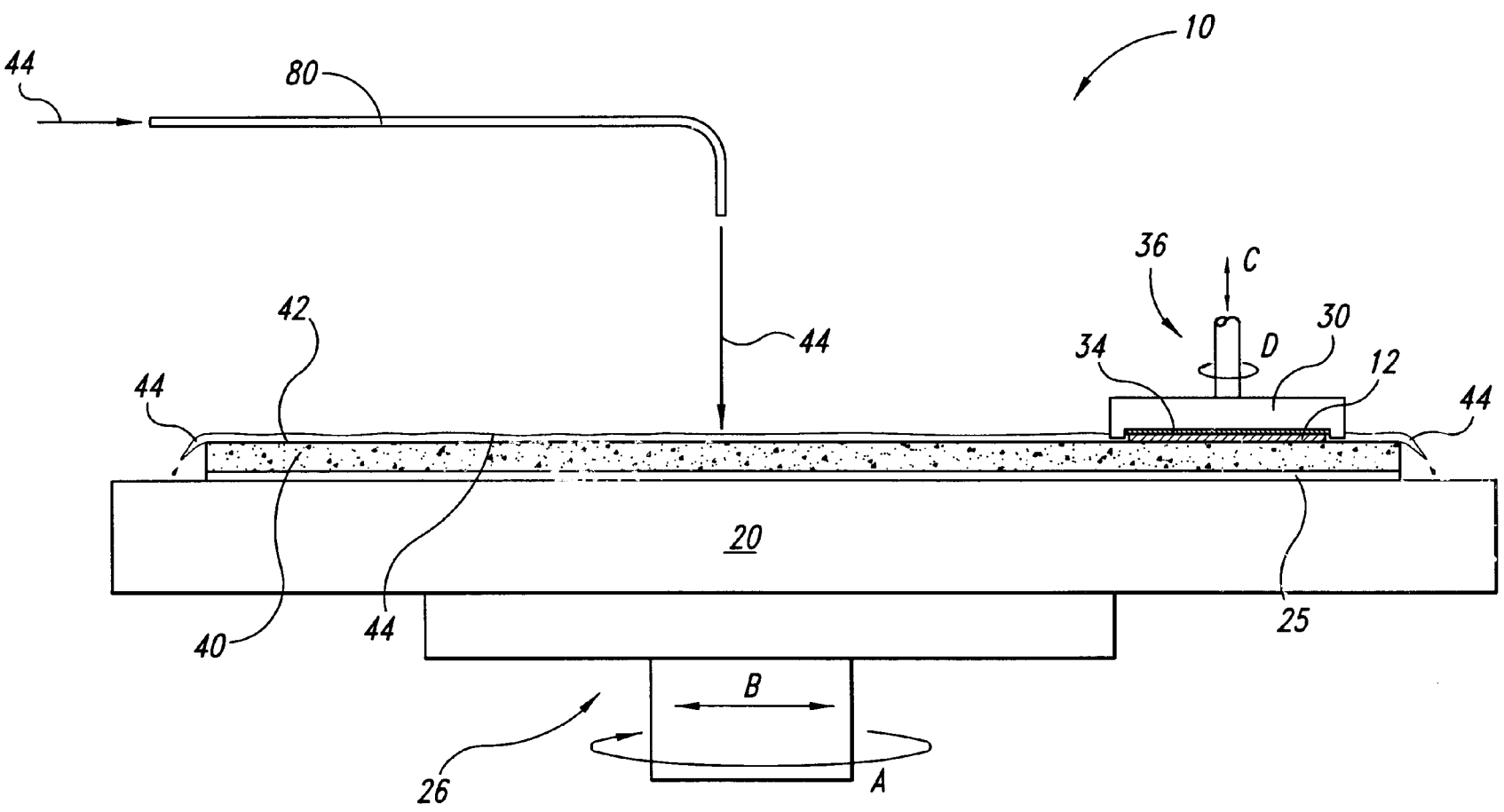
FIG. 6 is a schematic cross-sectional view of a wafer being planarized in accordance with a chemical-mechanical planarization method of the invention.
Figure 7:
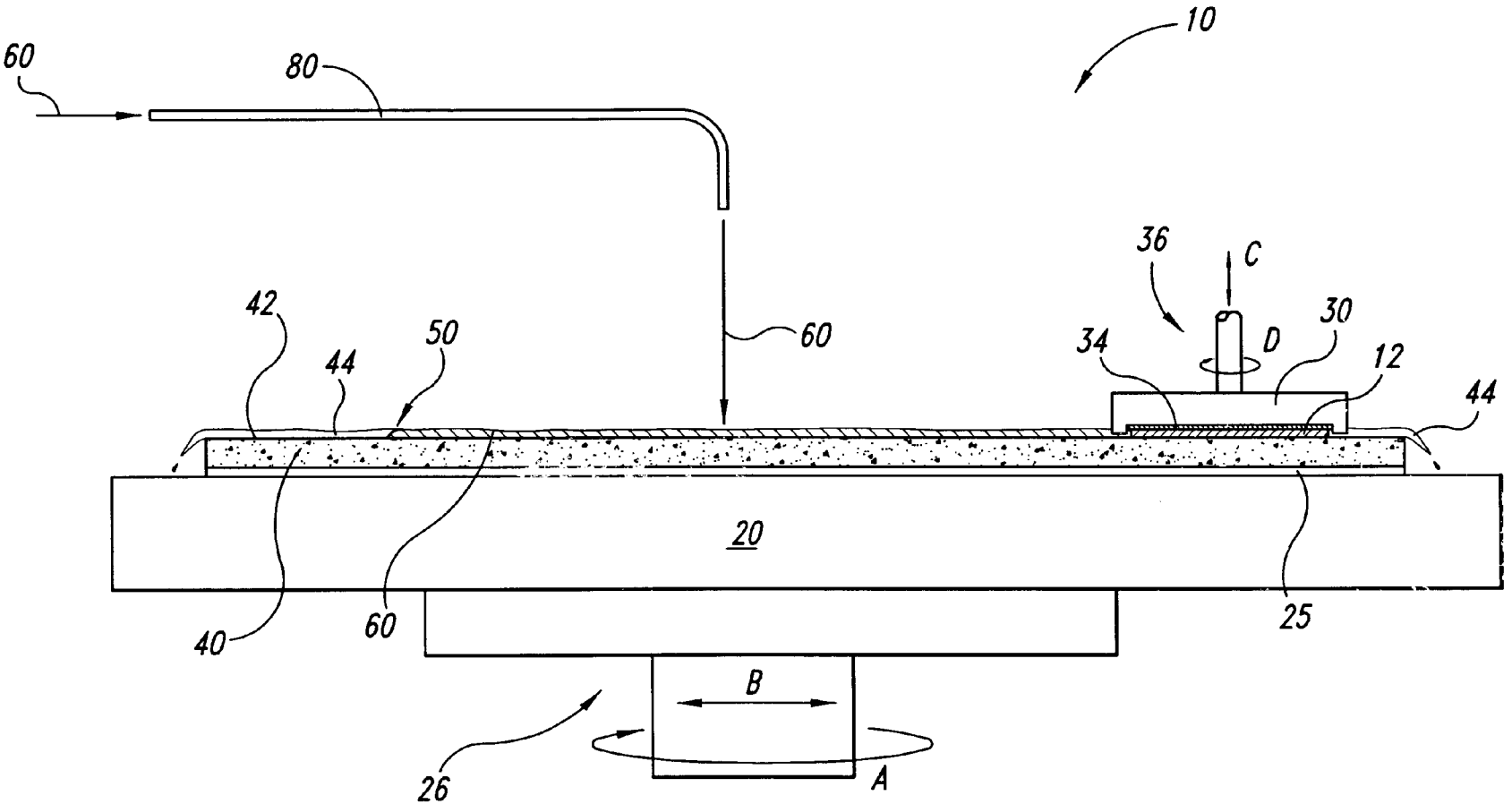
FIG. 7 is a schematic cross-sectional view of the wafer of FIG. 6 being planarized at another point in the chemical-mechanical planarization method of the invention.
Figure 8:
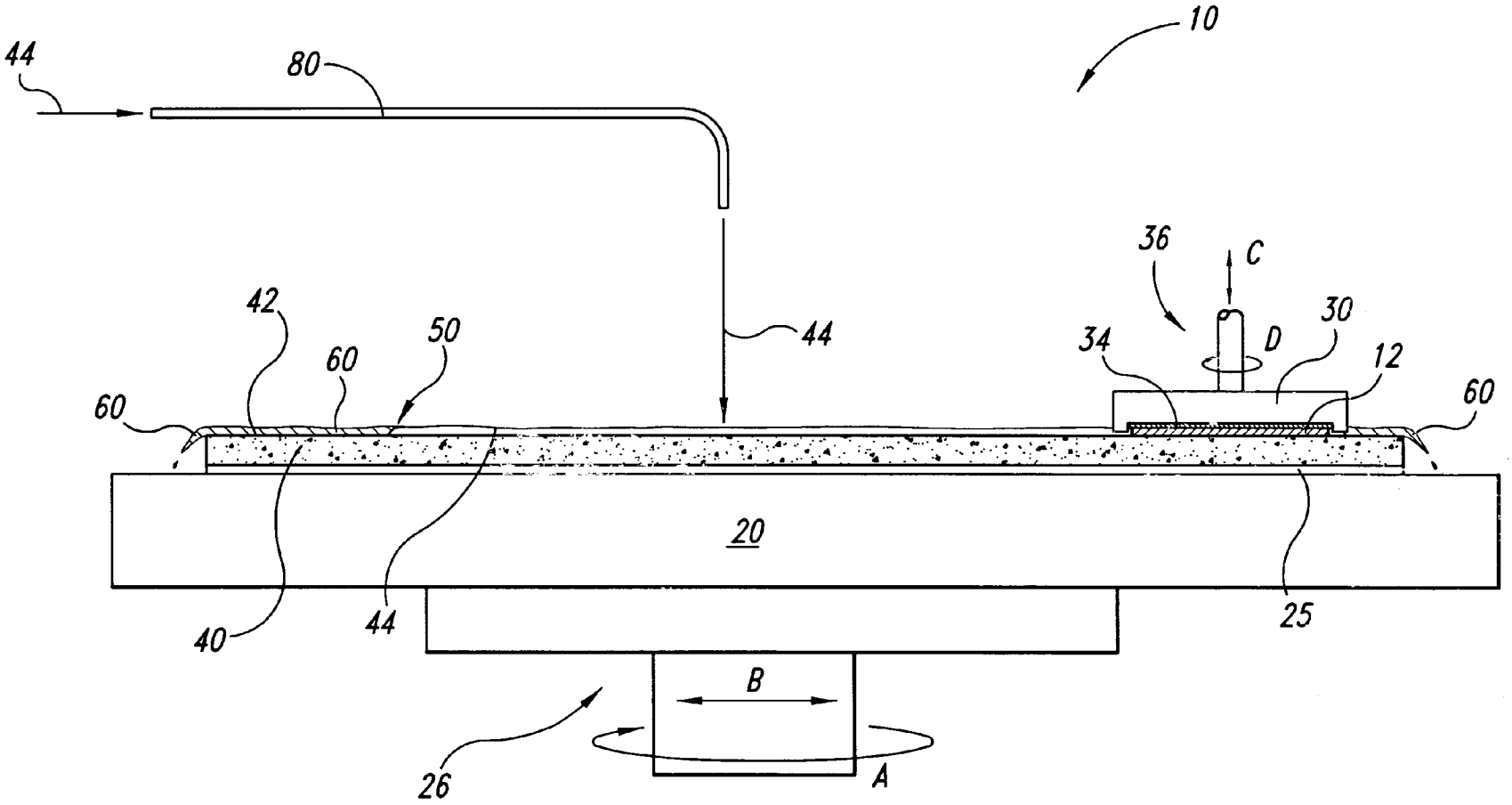
FIG. 8 is a schematic cross-sectional view of the wafer of FIG. 6 being planarized at yet another point in the chemical-mechanical planarization method of the invention.

FIGS. 6–8 illustrate a method for chemical-mechanical planarization of a semiconductor wafer in which the wafer 12 is placed proximate to a polishing pad 40 in the presence of a slurry solution 44. As discussed above with respect to FIG. 1, the wafer is held by a wafer carrier 30, and at least one of the wafer 12 or the polishing pad 40 is moved with respect to the other to impart relative motion therebetween and remove material from the wafer 12. In FIG. 6, the slurry solution 44 flows through the pipe 80 and is deposited onto the center of the polishing pad 40 while the polishing pad 40 rotates. The slurry 44 accordingly flows radially outwardly off the perimeter of the polishing pad 40 as the wafer 12 is planarized. After the wafer 12 is partially polished and waste matter (not shown) accumulates on the polishing pad 40, the slurry 44 is stopped and the conditioning solution 60 is deposited onto the polishing pad 40 through the pipe 80.

FIG. 7 illustrates the chemical-mechanical planarization process shortly after the conditioning solution 60 is deposited on the polishing pad 40. The conditioning solution 60 flows radially outwardly across the top of the polishing pad 40 to occupy the space vacated by the slurry 44 and to sweep residual slurry off of the polishing pad 40. Accordingly, before the conditioning solution 60 coats the whole surface of the polishing pad 40, a boundary layer 50 between the conditioning solution 60 and the slurry 44 progresses radially outwardly across the pad 40. Importantly, the wafer 12 need not be removed from the polishing pad 40 while the conditioning solution 60 removes waste matter from the polishing pad because the conditioning solution 60 does not damage the wafer nor does it break the waste matter into particles that may damage the wafer 12.

FIG. 8 illustrates the resumption of the planarization process in which the slurry 44 is redeposited onto the polishing pad 40 through the pipe 80. As with the deposition of the conditioning solution 60 on the polishing pad 40, the slurry 44 moves radially outwardly across the surface of the polishing pad 40 to occupy the space vacated by the conditioning solution 60 and to sweep residual conditioning solution 60 off of the perimeter of the polishing pad 40. It will be further appreciated that the polishing pad 40 need not be cleaned after the conditioning cycle because the slurry solution 44 and the conditioning solution 60 are compatible with one another.

One advantage of the method of the present invention is that the polishing pad 40 may be conditioned in a shorter period of time compared to conventional conditioning methods that use an abrasive disk. By conditioning the polishing pad 40 solely with a conditioning solution, the method of the invention does not produce any large particles that may damage the wafer. The wafer 12 may accordingly remain on the polishing pad 40 during the conditioning cycle, and the polishing pad 40 does not need to be cleaned after the conditioning cycle is completed. Thus, compared to conventional conditioning methods that use an abrasive disk, the method of the present invention conditions the pad in less time and enhances the throughput of the CMP process.

It will be appreciated that, although specific embodiments of the invention have been described herein for purposes of illustration, various modifications may be made without departing from the spirit and scope of the invention. Accordingly, the invention is not limited except as by the appended claims.

What is claimed is:

1. A method for the abrasive planarization of a semiconductor wafer, comprising the steps of:

placing a semiconductor wafer proximate to a polishing pad in the presence of a non-reactive slurry solution, the wafer being held by a wafer carrier;

moving at least one of the wafer or the polishing pad with respect to the other to impart relative motion therebetween, thereby removing material from the wafer and causing waste matter to accumulate on the polishing pad; and dissolving a desired amount of the waste matter with a selected conditioning solution without mechanically abrading the waste matter from the pad.

2. The method of claim 1 wherein the dissolving step occurs while the wafer remains closely adjacent to the polishing pad in a position in which the wafer can be planarized.

3. The method of claim 1, further comprising removing the conditioning solution containing the dissolved waste matter from the polishing pad.

4. A method for the abrasive planarization of a semiconductor wafer, comprising the steps of:

placing a semiconductor wafer proximate to a polishing pad in the presence of a non-reactive slurry solution, the wafer being held by a wafer carrier;

moving at least one of the wafer or the polishing pad with respect to the other to impart relative motion therebetween and remove material from the wafer;

coating a polishing surface on the polishing pad with a conditioning solution that dissolves accumulations of waste matter on the polishing pad, the conditioning solution remaining on the polishing surface for an adequate period of time to dissolve a desired amount of waste matter to bring the pad into a desired condition without abrading the waster matter from the polishing pad; and removing at least a substantial portion of the conditioning solution from the pad, the dissolved waste matter being substantially removed from the pad along with the removed conditioning solution.

5. The method of claim 4 wherein the dissolving step occurs while the wafer remains closely adjacent to the polishing pad in a position in which the wafer can be planarized.

6. The method of claim 4 wherein the wafer is not removed from the pad during the coating and removing steps, and the moving step is repeated after the removing step.

7. A method for the abrasive planarization of a semiconductor wafer, comprising:

removing material from an undoped silicon oxide film on a semiconductor wafer by pressing the wafer against a planarizing surface of a polishing pad in the presence of a slurry comprised of abrasive particles suspended in a non-reactive suspension medium, and moving at least one of the wafer or the polishing pad with respect to the other to impart relative motion therebetween, at least a portion of the undoped silicon oxide film accumulating on the planarizing surface; and dissolving a desired amount of the undoped silicon oxide accumulation on the polishing pad with a selected conditioning solution without mechanically abrading the undoped silicon oxide from the pad after removing material from the undoped silicon oxide film on the semiconductor wafer.

8. The method of claim 7, further comprising maintaining the wafer closely adjacent to the polishing pad in a position in which the wafer can be planarized while dissolving a desired amount of the undoped silicon oxide accumulation with the conditioning solution.

9. The method of claim 7, further comprising removing the conditioning solution containing the dissolved undoped silicon oxide from the polishing pad by rotating the polishing pad so that the conditioning solution flows radially outwardly off of the perimeter of the polishing pad.

10. A method for the abrasive planarization of a semiconductor wafer, comprising:

removing material from an undoped silicon oxide film on a semiconductor wafer by pressing the wafer against a planarizing surface of a polishing pad in the presence of a slurry comprised of abrasive particles suspended in a non-reactive suspension medium, and moving at least one of the wafer or the polishing pad with respect to the other to impart relative motion therebetween, at least a portion of the undoped silicon oxide film accumulating on the planarizing surface;

coating the planarizing surface of the polishing pad with a conditioning solution after removing material from the undoped silicon oxide film on the semiconductor wafer, the conditioning solution dissolving at least a portion of the undoped silicon oxide accumulation on the planarizing surface to bring the pad into a planarizing condition without abrading the planarizing surface; and removing at least a substantial portion of the conditioning solution from the pad, the dissolved undoped silicon oxide being substantially removed from the pad along with the removed conditioning solution.

11. The method of claim 10, further comprising maintaining the wafer closely adjacent to the polishing pad in a position in which the wafer can be planarized while dissolving the undoped silicon oxide accumulation with the conditioning solution.

12. The method of claim 10 wherein removing the conditioning solution containing the dissolved undoped silicon oxide from the polishing pad comprises rotating the polishing pad so that the conditioning solution flows radially outwardly off of the perimeter of the polishing pad.

13. A method of claim 10 wherein the wafer is not removed from the pad when coating the polishing pad with the conditioning solution or when removing at least a substantial portion of the conditioning solution from the pad.

14. A method for the abrasive planarization of a semiconductor wafer, comprising:

removing material from a doped silicon oxide film on a semiconductor wafer by pressing the wafer against a planarizing surface of a polishing pad in the presence of a slurry comprised of abrasive particles suspended in a non-reactive suspension medium, and moving at least one of the wafer or the polishing pad with respect to the other to impart relative motion therebetween, at least a portion of the doped silicon oxide film accumulating on the planarizing surface; and dissolving a desired amount of the doped silicon oxide accumulation on the polishing pad with a selected conditioning solution without mechanically abrading the doped silicon oxide from the pad after removing material from the doped silicon oxide film on the semiconductor wafer.

15. The method of claim 14, further comprising maintaining the wafer closely adjacent to the polishing pad in a position in which the wafer can be planarized while dissolving a desired amount of the doped silicon oxide accumulation with the conditioning solution.

16. The method of claim 14, further comprising moving the conditioning solution containing the dissolved doped silicon oxide from the polishing pad by rotating the polishing pad so that the conditioning solution flows radially outwardly off of the perimeter of the polishing pad.

17. A method for the abrasive planarization of a semiconductor wafer, comprising:

removing material from a doped silicon oxide film on a semiconductor wafer by pressing the wafer against a planarizing surface of a polishing pad in the presence of a slurry comprised of abrasive particles suspended in a non-reactive suspension medium, and moving at least one of the wafer or the polishing pad with respect to the other to impart relative motion therebetween, at least a portion of the doped silicon oxide film accumulating on the planarizing surface;

coating the planarizing surface of the polishing pad with a conditioning solution after removing material from the doped silicon oxide film on the semiconductor wafer, the conditioning solution dissolving at least a portion of the doped silicon oxide accumulations on the planarizing surface to bring the pad into a planarizing condition without abrading the planarizing surface; and removing at least a substantial portion of the conditioning solution from the pad, the dissolved doped silicon oxide being substantially removed from the pad along with the removed conditioning solution.

18. The method of claim 17, further comprising maintaining the wafer closely adjacent to the polishing pad in a position in which the wafer can be planarized while dissolving a desired amount of the doped silicon oxide accumulation with the conditioning solution.

19. The method of claim 17 wherein removing the conditioning solution containing the dissolved doped silicon oxide from the polishing pad comprises rotating the polishing pad so that the conditioning solution flows radially outwardly off of the perimeter of the polishing pad.

20. The method of claim 17 wherein the wafer is not removed from the pad when coating the polishing pad with the conditioning solution or when removing at least a substantial portion of the conditioning solution from the pad.

* * * * *